US009026018B2

(12) United States Patent
Miyoshi et al.

(10) Patent No.: US 9,026,018 B2
(45) Date of Patent: May 5, 2015

(54) TRANSFER DEVICE AND IMAGE FORMING APPARATUS

(71) Applicant: Fuji Xerox Co., Ltd., Tokyo (JP)

(72) Inventors: Ayaka Miyoshi, Kanagawa (JP); Atsuhito Tokuyama, Kanagawa (JP); Yoshiya Mashimo, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 91 days.

(21) Appl. No.: 13/974,672

(22) Filed: Aug. 23, 2013

(65) Prior Publication Data

US 2014/0294451 A1 Oct. 2, 2014

(30) Foreign Application Priority Data

Mar. 27, 2013 (JP) ..... 2013-065298

(51) Int. Cl.
*G03G 15/01* (2006.01)
*G03G 15/16* (2006.01)

(52) U.S. Cl.
CPC ..... *G03G 15/167* (2013.01); *G03G 15/1605* (2013.01); *G03G 2215/0129* (2013.01)

(58) Field of Classification Search
USPC ..... 399/302
See application file for complete search history.

(56) References Cited

U.S. PATENT DOCUMENTS

| | | | | |
|---|---|---|---|---|
| 6,026,269 | A * | 2/2000 | Setoriyama | 399/302 |
| 6,816,178 | B2 * | 11/2004 | Yamada et al. | 347/116 |
| 7,133,626 | B2 * | 11/2006 | Kaiga et al. | 399/110 |
| 2005/0063739 | A1 * | 3/2005 | Kobayashi et al. | 399/299 |
| 2012/0045231 | A1 * | 2/2012 | Ogino et al. | 399/45 |
| 2012/0045237 | A1 * | 2/2012 | Aoki et al. | 399/66 |

FOREIGN PATENT DOCUMENTS

JP B2-4054496 2/2008

* cited by examiner

*Primary Examiner* — Clayton E Laballe
*Assistant Examiner* — Warren K Fenwick
(74) *Attorney, Agent, or Firm* — Oliff PLC

(57) ABSTRACT

A transfer device includes an endless intermediate transfer belt that moves circularly, a first rotating body pressed into contact with the inner surface of the belt, and a second rotating body disposed at a position facing the first rotating body to contact with the outer surface of the belt. The belt includes a first pressing section that is in contact with the second rotating body due to a first pressure from the first rotating body such that a toner image that has been first-transferred to the outer surface of the belt is second-transferred onto a recording medium that passes between the belt and the second rotating body and a second pressing section that is in contact with the second rotating body due to a second pressure smaller than the first pressure on the upstream side of the first pressing section in the belt movement direction.

19 Claims, 7 Drawing Sheets

TRANSFER DEVICE AND IMAGE FORMING APPARATUS

CROSS-REFERENCE TO RELATED APPLICATIONS

This application is based on and claims priority under 35 USC 119 from Japanese Patent Application No. 2013-065298 filed Mar. 27, 2013.

BACKGROUND (i) Technical Field

The present invention relates to a transfer device and an image forming apparatus.

(ii) Related Art

In an image forming apparatus such as a copying machine or a printer, a unfixed toner image that has been formed in an image forming unit is first-transferred onto an intermediate transfer belt, the unfixed toner image, which has been transferred to the intermediate transfer belt, is second-transferred onto a recording medium, and the unfixed toner image, which has been transferred to the recording medium, is heated and applied with pressure in a fixing device, so that an image is formed.

SUMMARY

According to an aspect of the invention, there is provided a transfer device including an endless intermediate transfer belt that moves circularly, a first rotating body that is disposed in such a manner as to be pressed into contact with an inner circumferential surface of the intermediate transfer belt, and a second rotating body that is disposed at a position facing the first rotating body in such a manner as to be in contact with an outer circumferential surface of the intermediate transfer belt. The intermediate transfer belt includes a first pressing section in which the intermediate transfer belt is in contact with the second rotating body due to a first pressure applied from the first rotating body in such a manner that a toner image that has been first-transferred to the outer circumferential surface of the intermediate transfer belt is second-transferred onto a recording medium that passes between the intermediate transfer belt and the second rotating body and a second pressing section in which the intermediate transfer belt is in contact with the second rotating body due to a second pressure that is smaller than the first pressure on an upstream side of the first pressing section in a movement direction of the intermediate transfer belt.

BRIEF DESCRIPTION OF THE DRAWINGS

Exemplary embodiments of the present invention will be described in detail based on the following figures, wherein:

FIG. 12A illustrating the configuration illustrated in FIG. 2 with a second transfer belt provided in place of the second transfer roller, and FIG. 12B illustrating the configuration illustrated in FIG. 12A with a long second transfer belt provided in place of the pre-roller and the second transfer belt in such a manner as to extend over the upstream and downstream sides of the backup roller.

DETAILED DESCRIPTION

<Image Forming Apparatus>

Figure 1:
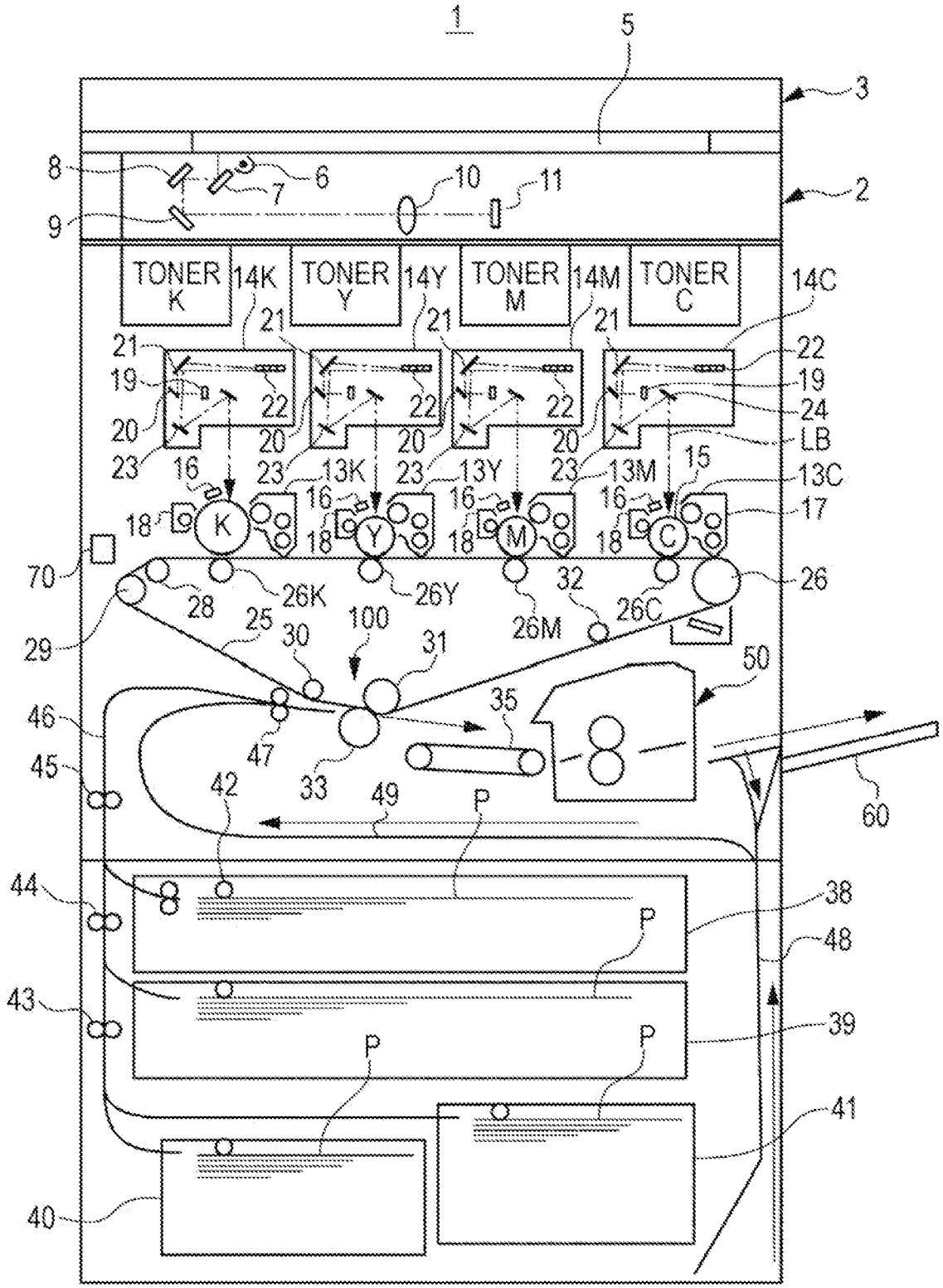
FIG. 1 is a schematic diagram of a full-color printer that is an example of an image forming apparatus in which a transfer device according to an exemplary embodiment of the invention is applied.

Exemplary embodiments will now be described in detail below with reference to the drawings. FIG. 1 is a schematic diagram of a full-color printer employing a tandem system that is an example of an image forming apparatus in which a transfer device according to an exemplary embodiment of the invention is applied. Note that the full-color printer employing a tandem system includes an image reading device and also functions as a full-color copying machine. The full-color printer need not include an image reading device.

In FIG. 1, the full-color printer includes a full-color printer body 1, and a scanner 2 is disposed on a top portion of the full-color printer body 1 as an image reading device (IIT: image input terminal) that reads an image of a document. The document is not illustrated in FIG. 1.

In the scanner 2, a light source 6 radiates its light onto the document that has been transferred to a platen glass 5 by an automatic document transport device (ADF: auto document feeder) 3. An optical image reflected from the document is caused to scan and irradiate an image reading element 11 that is formed of a charge coupled device (CCD) or the like via a reducing optical system that includes a full-rate mirror 7, half-rate mirrors 8 and 9, and an imaging lens 10. The image of the document is read by the image reading element 11 at a predetermined dot density (e.g., 1200 dpi or 2400 dpi).

The image of the document that has been read by the scanner 2 is sent to an image processing system (not illustrated) as image data items each of which has one of three colors of, for example, red (R), green (G), and blue (B) and each of which is composed of 8 bits. In the image processing system, the image data items of the document are subjected to predetermined image processing such as shading correction, misregistration correction, brightness/color space conversion, gamma correction, frame erase, color/movement edition, and the like.

Then, the image data items, which have been subjected to the predetermined image processing in the image processing system as described above, are converted into image data items each of which has one of four colors of cyan (C), magenta (M), yellow (Y), and black (K) and each of which is composed of 8 bits and, as will be described below, the four image data items are sent to a corresponding one of a raster output scanner (ROS) 14C, a ROS 14M, a ROS 14Y, and a ROS 14K that respectively correspond to a cyan (C) image forming unit 13C, a magenta (M) image forming unit 13M, a yellow (Y) image forming unit 13Y, and a black (K) image forming unit 13K. The ROS 14C, the ROS 14M, the ROS 14Y, and the ROS 14K perform image exposure using their laser beams LB in accordance with the corresponding image data items.

In the full-color printer body 1, the cyan (C) image forming unit 13C, the magenta (M) image forming unit 13M, the yellow (Y) image forming unit 13Y, and the black (K) image forming unit 13K are arranged in series at a certain pitch in the horizontal direction.

In addition, the full-color printer body 1 includes, in the interior thereof, photoconductor drums 15 that are examples of image carriers each of which carries a toner image of a different color, first transfer rollers 26C, 26M, 26Y, 26K that are examples of first transfer units that transfer the toner images carried on the photoconductor drums 15 onto an intermediate transfer belt 25 in such a manner that the toner images are superimposed, and a transfer device 100 that is an example of a second transfer unit that collectively second-transfers the toner images, which have been first-transferred to the intermediate transfer belt 25 in such a manner that the toner images are superimposed, onto a recording medium.

Basically, the image forming units 13C, 13M, 13Y, and 13K are configured in a similar manner, and each of the image forming units 13C, 13M, 13Y, and 13K includes a corresponding one of the photoconductor drums 15 that rotate at a predetermined speed, a scorotron 16 for first charging (or may be a charging roller) that uniformly charges a surface of the corresponding photoconductor drum 15, the corresponding one of the ROS 14C, the ROS 14M, the ROS 14Y, and the ROS 14K each of which forms an electrostatic latent image on the surface of the corresponding photoconductor drum 15 by exposing the image having the corresponding color with its laser beam, a developing device 17 that develops the electrostatic latent image, which has been formed on the corresponding photoconductor drum 15, with toner of the corresponding color, and a cleaning device 18.

In FIG. 1, some of the reference numerals of the same components are omitted in order to simplify FIG. 1. Note that, in the exemplary embodiment, the diameter of the photoconductor drum 15 that is used in the image forming unit 13K that forms images of black (K) color is set to be larger than those of the photoconductor drums 15 of the image forming units 13C, 13M, and 13Y that form images of the other colors.

Each of the ROS 14C, the ROS 14M, the ROS 14Y, and the ROS 14K for the corresponding colors modulates a corresponding one of semiconductor lasers 19 in accordance with an image data item and emits the laser beam LB from the corresponding semiconductor laser 19 in accordance with the image data item. The laser beam LB emitted from each of the semiconductor lasers 19 is caused to be deflected and scanned by a corresponding one of rotating polygon mirrors 22 via corresponding reflecting mirrors 20 and 21, and the laser beam LB is caused to scan and irradiate the corresponding photoconductor drum 15, which is an image carrier, via corresponding reflecting mirrors 23 and 24 and the like in a state where the focal length is adjusted by an f-θ lens (not illustrated) in accordance with a scanning angle.

The image data items of different colors are sequentially output from the image processing system to the corresponding ROS 14C, the ROS 14M, the ROS 14Y, and the ROS 14K of the cyan (C) image forming unit 13C, the magenta (M) image forming unit 13M, the yellow (Y) image forming unit 13Y, and the black (K) image forming unit 13K, and the laser beams LB emitted from the ROS 14C, the ROS 14M, the ROS 14Y, and the ROS 14K in accordance with the image data items are caused to scan and irradiate the surfaces of the corresponding photoconductor drums 15, so that electrostatic latent images are formed. The electrostatic latent images, which have been formed on the photoconductor drums 15 that carry toner images of different colors, are developed into toner images of cyan (C), magenta (M), yellow (Y), and black (K) colors by the developing devices 17 that use toner of the corresponding colors.

As illustrated in FIG. 1, the toner images of cyan (C), magenta (M), yellow (Y), and black (K) colors, which have been sequentially formed on the photoconductor drums 15 of the image forming units 13C, 13M, 13Y, and 13K, are transferred onto the intermediate transfer belt 25, which is disposed below the image forming units 13C, 13M, 13Y, and 13K, by the first transfer rollers 26C, 26M, 26Y, and 26K in such a manner as to be superimposed.

The intermediate transfer belt 25 is stretched by a drive roller 26, a tension roller 28, a steering roller 29, a pre-roller 30 that is an example of a third rotating body, a backup roller 31 that is an example of a first rotating body, and an idle roller 32 with a certain tension and is driven so as to rotate at a predetermined speed the same as a speed at which the photoconductor drums 15 rotate by the drive roller 26, which is driven so as to rotate by a dedicated drive motor having a good constant speed characteristic (not illustrated). For example, a flexible film made of a synthetic resin such as a polyimide that is formed in an endless belt is used as the intermediate transfer belt 25.

The toner images of cyan (C), magenta (M), yellow (Y), and black (K) colors, which have been transferred to the intermediate transfer belt 25 in such a manner as to be superimposed, are second-transferred with a press-contact force and an electrostatic force onto a recording sheet P, which is an example of a recording medium, by the second transfer roller 33, which is an example of a second rotating body and which is pressed into contact with the backup roller 31 with the intermediate transfer belt 25 interposed therebetween. The transfer device 100 of the exemplary embodiment includes the intermediate transfer belt 25, the backup roller 31, the second transfer roller 33, and the pre-roller 30. The transfer device 100 will be described in detail later. Note that, FIG. 1 illustrates an example in which the pre-roller 30 is disposed on the upstream side in the movement direction of the intermediate transfer belt 25 in such a manner as to be somewhat separated from the second transfer roller 33. However, as will be described later, the exemplary embodiments of the invention are not limited to this.

The recording sheet P that is caused to move while carrying the unfixed toner images of different colors on a surface thereof is transported to a fixing device 50 by a transport belt 35. Then, the recording sheet P to which the toner images of different colors have been transferred is subjected to a fixing treatment using heat and pressure by the fixing device 50, and in the case of single-sided printing, the recording sheet P is ejected onto an ejection tray 60 that is disposed the outside of the full-color printer body 1.

As illustrated in FIG. 1, the recording sheet P having a predetermined size or made of a predetermined material is transported from one of sheet trays 38, 39, 40, and 41 to a pair of registration rollers 47 via a corresponding one of a sheet feed rollers 42 and a sheet transport path 46 that includes pairs of rollers 43, 44, and 45 for transporting sheets and then is caused to stop. The recording sheet P, which has been supplied from one of the sheet trays 38, 39, 40, and 41, is sent out to a second transfer position of the intermediate transfer belt 25 by the pair of registration rollers 47 that is driven so as to rotate at a predetermined timing.

In the case where an image is to be formed on both sides of the recording sheet P by the full-color printer, the recording sheet P having an image fixed on one side thereof by the fixing device 50 is not ejected to the outside of the full-color printer, and the transport path of the recording sheet P is switched to a transport path that is oriented downward by a switching gate (not illustrated), so that the recording sheet P is temporarily transported to a sheet transport path 48 for inversion of transport direction. Then, in a state where the transport direction of the recording sheet P is inverted, the recording sheet P, which has been transported to the sheet transport path 48 for inversion of transport direction, is transported again to the second transfer position of the intermediate transfer belt 25 via a sheet transport path 49 for two-sided printing and the normal sheet transport path 46 with the front and rear surfaces of the recording sheet P reversed. After an image has been formed on the rear surface, the recording sheet P is subjected to a fixing treatment using heat and pressure by the fixing device 50 and is ejected onto the ejection tray 60, which is disposed the outside of the full-color printer body 1.

The full-color printer body 1 further includes an arithmetic unit such as a central processing unit (CPU), a memory, and a controller 70 that controls the operation of each unit of the full-color printer body 1.

<Transfer Device>

Figure 2:
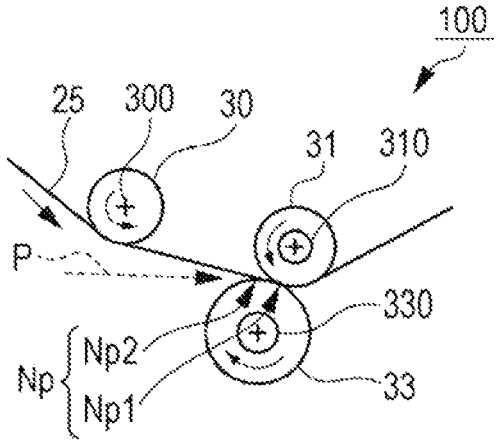
FIG. 2 is a schematic cross-sectional view of the transfer device according to the exemplary embodiment of the invention illustrating an intermediate transfer belt, a backup roller, a second transfer roller, and a pre-roller.
Figure 3:
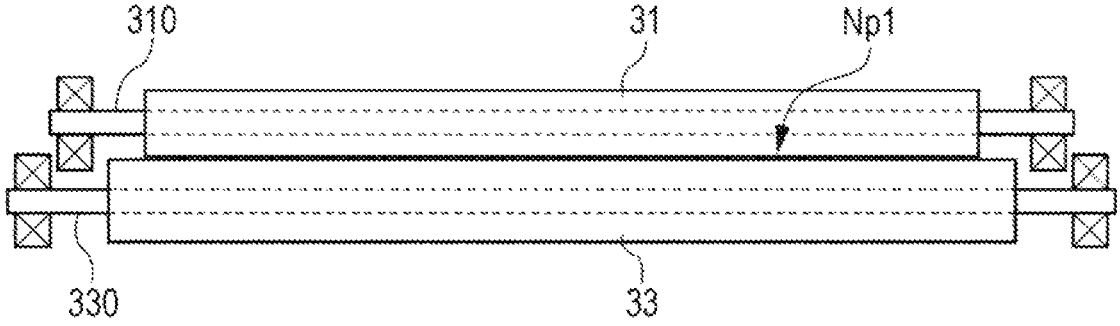
FIG. 3 is a schematic front view of the backup roller and the second transfer roller illustrated in FIG. 2 as viewed from the downstream side.

FIG. 2 is a schematic cross-sectional view of the transfer device 100 according to the exemplary embodiment of the invention. FIG. 3 is a schematic front view of FIG. 2 as viewed from the downstream side illustrating the backup roller 31 and the second transfer roller 33.

The transfer device 100 includes the endless intermediate transfer belt 25 that moves circularly, the backup roller 31 that corresponds to the first rotating body and that is arranged in such a manner as to be pressed into contact with the inner circumferential surface of the intermediate transfer belt 25, and the second transfer roller 33 that corresponds to the second rotating body and that is disposed at a position facing the backup roller 31 in such a manner as to be in contact with the outer circumferential surface of the intermediate transfer belt 25. The intermediate transfer belt 25 includes a first pressing section Np1 in which the intermediate transfer belt 25 is in contact with the second transfer roller 33 due to a first pressure applied from the backup roller 31 in such a manner that a toner image that has been first-transferred to the outer circumferential surface of the intermediate transfer belt 25 is second-transferred onto the recording sheet P that passes between the intermediate transfer belt 25 and the second transfer roller 33 and a second pressing section Np2 in which the intermediate transfer belt 25 is in contact with the second transfer roller 33 due to a second pressure that is smaller than the first pressure in order to apply pressure in advance, on the immediately upstream side of the first pressing section Np1 in the movement direction of the intermediate transfer belt 25, to a toner image that has not been second-transferred so that the toner image is prevented from being scattered due to air flow generated by a toner image that is being second-transferred, the intermediate transfer belt 25, and the recording sheet P.

Here, FIG. 2 illustrates the case where the pre-roller 30 is disposed on the upstream side in the movement direction of the intermediate transfer belt 25 in such a manner as to be somewhat separated from the second transfer roller 33 as a unit that forms the second pressing section Np2 between the intermediate transfer belt 25 and the second transfer roller 33. In FIG. 2, the intermediate transfer belt 25 moves circularly in a direction indicated by a corresponding one of solid arrows. Each of the pre-roller 30, the backup roller 31, and the second transfer roller 33 rotates in a direction indicated by a corresponding one of the solid arrows. In FIG. 2 and FIG. 3, each of the pre-roller 30, the backup roller 31, and the second transfer roller 33 has a substantially cylindrical shape that rotates about a corresponding one of rotation axes 300, 310, and 330 each of which is journaled.

The recording sheet P is to be transported from a direction indicated by a dashed arrow. The pre-roller 30 is disposed on the upstream side of the first pressing section Np1 in the movement direction of the intermediate transfer belt 25 in such a manner as to be pressed into contact with the inner circumferential surface of the intermediate transfer belt 25.

In FIG. 2 and FIG. 3, in the transfer device 100, a pressing section Np is formed by the intermediate transfer belt 25 and the second transfer roller 33. The pressing section Np includes the first pressing section Np1 that is formed by nipping the intermediate transfer belt 25 between the backup roller 31 and the second transfer roller 33 and applying the first pressure to the intermediate transfer belt 25 and the second pressing section Np2 that is formed by applying the second pressure to the intermediate transfer belt 25 toward the second transfer roller 33 using the pre-roller 30.

Figure 4:
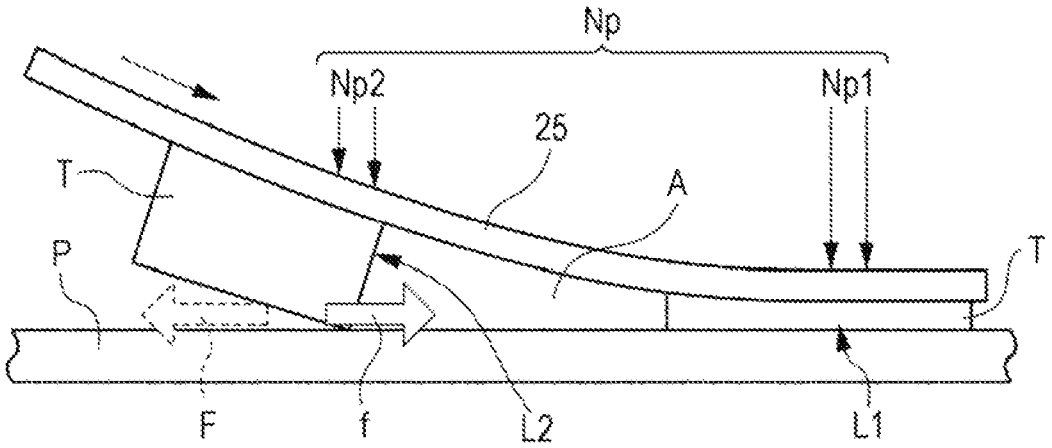
FIG. 4 is a schematic cross-sectional view illustrating the mechanism of scattering of unfixed toner that occurs between an intermediate transfer belt to which unfixed toner has been transferred and a recording sheet in the vicinity of a pressing section.
Figure 5:
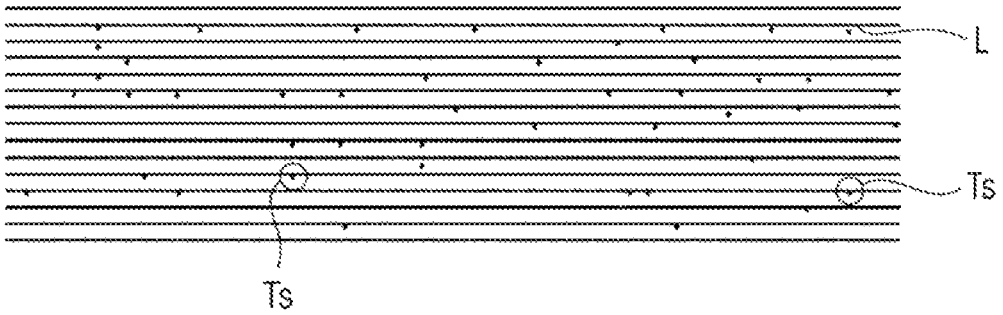
FIG. 5 is a schematic diagram illustrating a state of unfixed toner scattered from lines.

A relationship between scattering of toner that has not been second-transferred and a pressing section will now be described. FIG. 4 is a schematic cross-sectional view illustrating the mechanism of scattering of unfixed toner that occurs between the intermediate transfer belt 25 to which unfixed toner T has been transferred and the recording sheet P in the vicinity of the pressing section Np. In FIG. 4, the unfixed toner T forms lines L in, for example, a proximal-distal direction with respect to the recording sheet P as illustrated in FIG. 5. Note that, in FIG. 5, portions Ts that are illustrated as dots represent, as will be described later, toner scattered from the lines L.

In the first pressing section Np1, a large pressure is applied to the unfixed toner T compared with in the second pressing section Np2, and the first pressing section Np1 corresponds to a nip portion in which the unfixed toner T is to be transferred onto the recording sheet P. On the other hand, the second pressing section Np2 corresponds to a pre-nip portion in which a pressure that is smaller than the pressure to be applied in the first pressing section Np1 is applied in advance.

In the pressing section Np, air A is trapped between a line L1 and a line L2 that are formed of the unfixed toner T. When the intermediate transfer belt 25 moves in a direction of the arrow at high speed, pressure is suddenly applied to the air A. The high speed is, for example, the speed at which about 100 sheets are printed per minute. In this case, a fluid force F (a dashed arrow in FIG. 4) that is generated by air flow of the air A that tries to escape due to the pressure applied to the air A is applied to the line L2 that comes from the upstream side of the intermediate transfer belt 25. In the case where the second pressing section Np2 is not formed, part of the toner T that forms the line L2 is caused to be scattered toward the upstream side by the fluid force F generated by the air A that tries to escape. FIG. 5, which has been mentioned above, illustrates a state where the toner T is scattered from the lines L and illustrates a state where the toner Ts in the form of dots is scattered on the recording sheet P.

On the other hand, in the case where the second pressing section Np2 is formed, a reaction force f capable of acting against the fluid force F is generated by pressure applied to the line L2. The reaction force f is a force that tries to hold the toner T on the intermediate transfer belt 25 and is determined by an external load, an electrostatic force between the toner T and the recording sheet P, a frictional force between the toner T and the recording sheet P, and the like. With the reaction force f, scattering of unfixed toner is suppressed when a unfixed toner image is transferred onto a recording medium.

Figure 6:
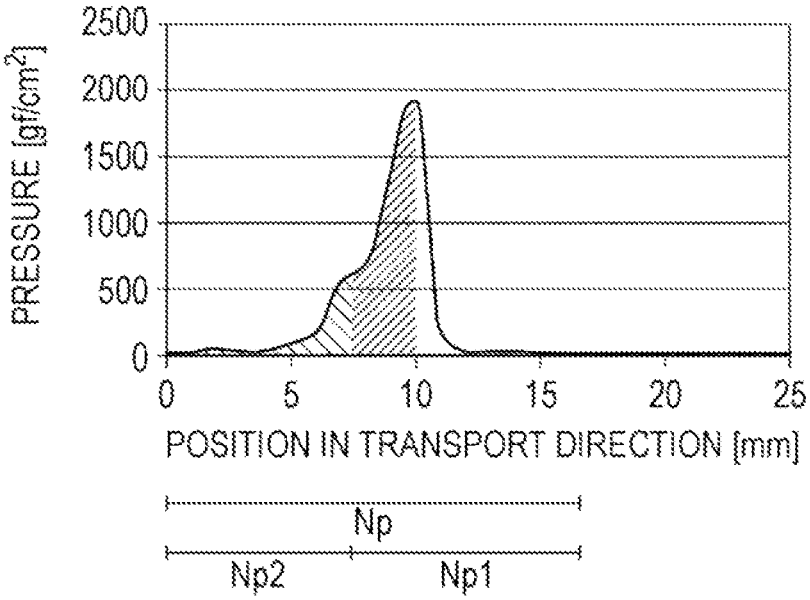
FIG. 6 is a graph representing an example of a pressure distribution in the pressing section with respect to a transport direction.

FIG. 6 is a graph representing an example of a pressure distribution in the pressing section Np with respect to a transport direction of the recording sheet P. The horizontal axis represents, in units of mm, a position in the transport direction from a reference position that is an arbitrary position on the upstream side in the transport direction at which substantially no pressure is applied. The vertical axis represents pressure at positions in the transport direction. In FIG. 6, the pressure distribution in the pressing section Np is formed by connecting a pressure distribution formed in the first pressing section Np1 and a pressure distribution formed in the first pressing section Np2. In the example, the pressure distribution formed in the first pressing section Np1 continues from the pressure distribution formed in the first pressing section Np2 while having a positive slope. As an example other than the above-described example, the pressure distribution formed in the first pressing section Np1 may continue from the pressure distribution formed in the first pressing section Np2 while being horizontal.

Measurement of the pressure distribution in the pressing section Np may be performed using, for example, a pressure distribution between rollers measurement system, PINCH (manufactured by Nitta Corporation), a tactile sensor T-4000/6000 (manufactured by Syscom Corporation), or the like.

Figure 7:
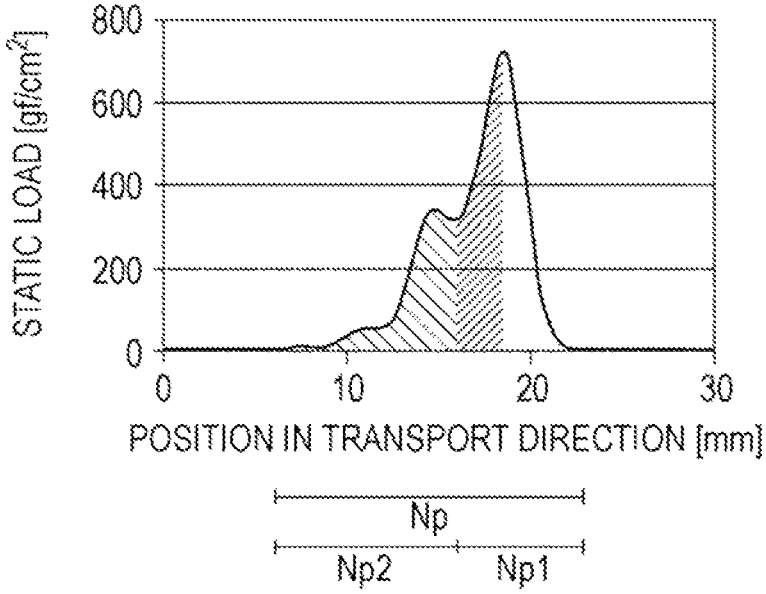
FIG. 7 is a graph representing an example of a not preferred pressure distribution in the pressing section with respect to the transport direction.

In contrast to FIG. 6, FIG. 7 is a graph representing an example of a not preferred pressure distribution in the pressing section Np with respect to the transport direction. In the example, the pressure distribution formed in the first pressing section Np1 continues from the pressure distribution formed in the first pressing section Np2 via a recess. Other than the above-mentioned example, not preferable examples includes the case where the pressure distribution formed in the first pressing section Np1 and the pressure distribution formed in the first pressing section Np2 are completely separated from each other.

Figure 8:
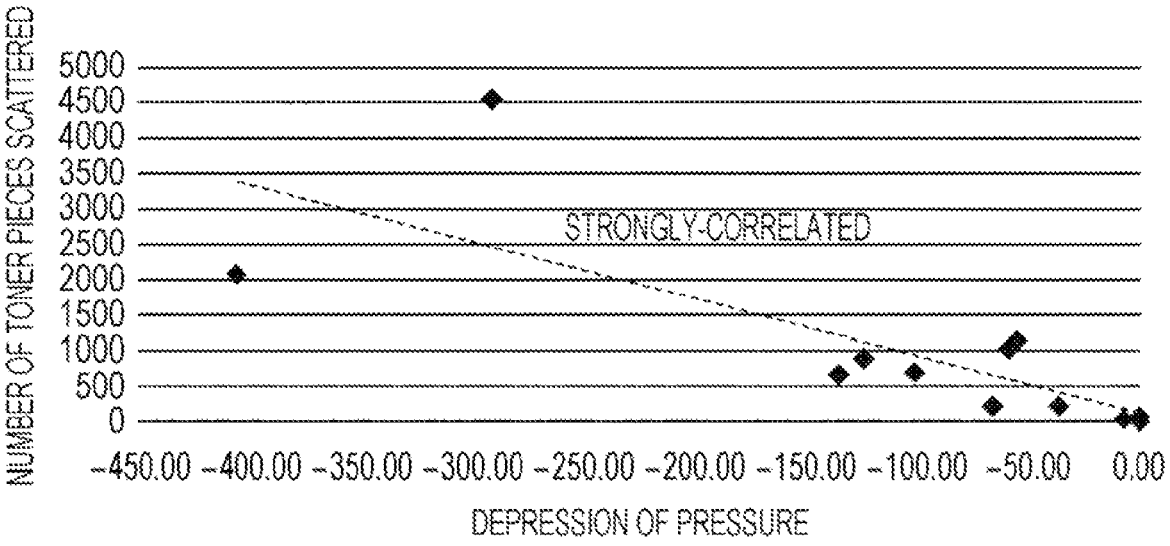
FIG. 8 is a graph representing the number of pieces of toner scattered in the case where a decrease of the pressure distribution is varied.

FIG. 8 illustrates a relationship between the number of pieces of the toner T scattered and a decrease of pressure. Here, the decrease of pressure is converted into numbers as follows. First, the moving average per 0.5 mm of the pressure distribution data is determined. Next, the slope of the moving average is calculated at 0.1 mm pitch. A negative slope in the second pressing section Np2 is extracted, and integration is performed. Then, these processes are performed on pressure distributions in In/Center/Out areas, and the sum of all the values is used as an index of the decrease of pressure.

As illustrated in FIG. 8, the number of pieces of the toner T scattered is strongly-correlated with the decrease of pressure. Scattering of the toner T is not observed when there is no decrease of pressure; however, when a decrease of pressure occurs, the number of the toner T scattered increases as the degree of the decrease becomes large. This shows the fact that, in the case where the pressure distribution formed in the first pressing section Np1 continues from the pressure distribution formed in the first pressing section Np2 while having a positive slope (the example illustrated in FIG. 6) or while being horizontal, scattering of unfixed toner is suppressed as compared with the case where the pressure distribution formed in the first pressing section Np1 continues from the pressure distribution formed in the first pressing section Np2 via a recess (the example illustrated in FIG. 7) or is completely separated from the pressure distribution formed in the first pressing section Np2.

That is to say, it is understood that the first pressure may continue from the peak of the second pressure while having a nonnegative slope. In other words, a recess that is present in pressure variations from the peak of the pressure in the second pressing section Np2 to the peak of the pressure in the first pressing section Np1 denotes that the reaction force f of the unfixed toner T instantaneously decreases in contrast to the fluid force F that gradually increases, and it is assumed that this results in collapse of the toner T. In contrast, when the first pressure continues from the peak of the second pressure while having a nonnegative slope, the reaction force f does not decrease, and collapse of the toner T may be suppressed.

Figure 9:
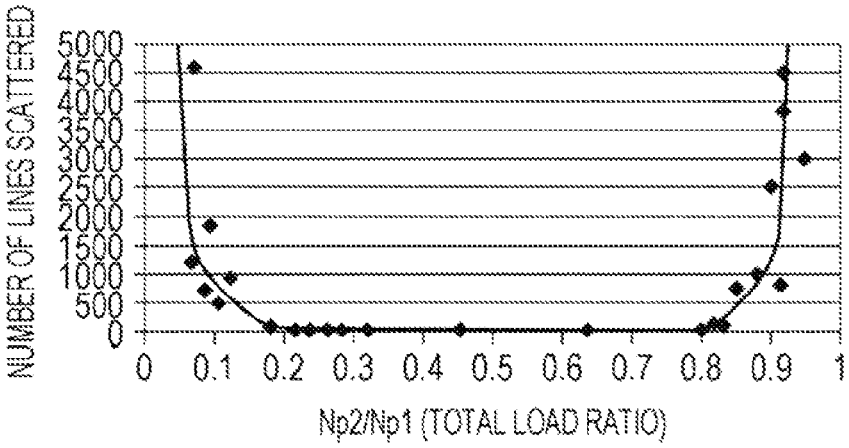
FIG. 9 is a graph representing the number of lines scattered in the case where the ratio of a total load in a second pressing section to a total load within the range from the boundary between the second pressing section and the first pressing section to a peak of the load is varied.

FIG. 9 is a graph representing the number of lines scattered in the case where the ratio of the total load in the second pressing section Np2 to the total load within the range from the boundary between the second pressing section Np2 and the first pressing section Np1 to a peak of the load is varied. Here, the number of lines scattered is the number of pieces of toner scattered that is counted under a detection condition of scattering distance of toner from a line image ≥5 dots after printing a total of 60 lines that are perpendicular to the transport direction and each of which has a line width of 8 dots on the recording sheet P that is an A3 sheet in the short edge feed (SEF) orientation in such a manner that each 12 lines of the 60 lines are printed at an interval of one of 0.5 mm, 1.5 mm, 2.5 mm, 3.5 mm, and 4.5 mm while the speed at which the recording sheet P is transported is set to 440 mm/s and performing an imaging scan at 600 dpi.

In FIG. 9, in the case where the ratio of the total load of the second pressure in the second pressing section Np2 to the total load of the first pressure within the range from the boundary between the second pressing section Np2 and the first pressing section Np1 to the peak of the first pressure is in the range of 0.2 to 0.8 or in the range of about 0.2 to about 0.8, the number of lines scattered is substantially zero. On the other hand, in the case where the ratio is outside of the range of 0.2 to 0.8 or about 0.2 to about 0.8, the number of lines scattered critically and rapidly increases. The transfer device 100 that suppresses scattering of unfixed toner when a unfixed toner image is transferred onto the recording sheet P is obtained.

Figure 10:
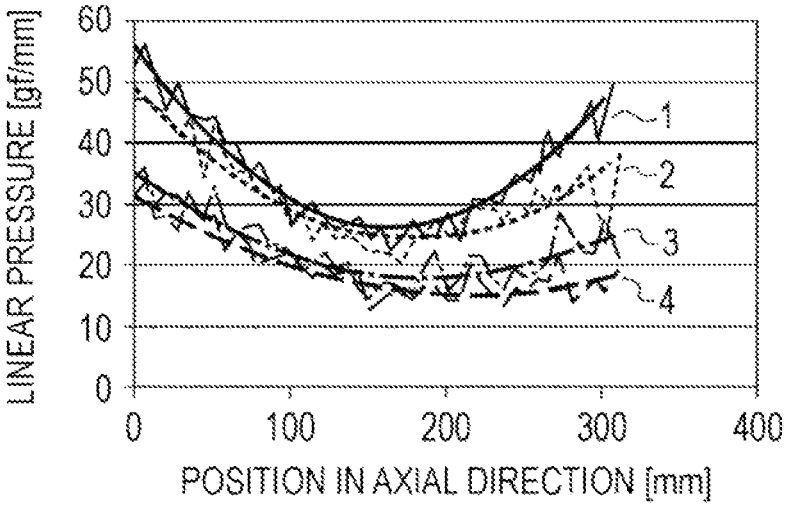
FIG. 10 is a graph representing a linear pressure distribution in the first pressing section in an axial direction.

FIG. 10 is a graph representing four examples of a linear pressure distribution in the first pressing section Np1 in an axial direction, that is, a distribution of linear pressure that is the pressure to be applied in the first pressing section Np1 in the axial directions of the backup roller 31 and the second transfer roller 33 illustrated in FIG. 3. The line width of the linear pressure applied is 3 mm.

When the pressure distribution of the second pressure in the axial directions of the backup roller 31 and the second transfer roller 33 is approximately expressed by a quadratic function in which the value at substantially the center in the axial directions is minimum, in each of the examples, a linear pressure S may be expressed by a quadratic function of $S=ax^2+bx+c$, where x is a position in the axial directions.

Here, a quadratic coefficient a of the quadratic function is 0.0011 in the example 1, 0.0008 in the example 2, 0.0005 in the example 3, and 0.0004 in the example 4. The linear pressure distribution in the axial directions occurs due to deflections of the backup roller 31 and the second transfer roller 33, and the linear pressure may be applied as uniformly as possible in the axial directions. The quadratic coefficient a represents the gentleness of the quadratic curve, and the difference between the linear pressure at the center and the linear pressure at the ends is reduced as the quadratic coefficient a becomes smaller. By setting the quadratic coefficient a of the quadratic function to a positive number of 0.001 or smaller or about 0.001 or smaller, the transfer device 100 that suppresses scattering of unfixed toner in the axial directions of the backup roller 31 and the second transfer roller 33 is obtained.

In the case where the linear pressure at the center is small, the pressure applied in the first pressing section Np1 is small, and the pressure applied in the second pressing section Np2 is large. On the other hand, in the case where the linear pressure at the ends in the axial directions is large, the pressure applied in the first pressing section Np1 is large, and the pressure applied in the second pressing section Np2 is small.

Although the transfer device of the exemplary embodiment and the image forming apparatus using the transfer device have been described the above, the transfer device and the image forming apparatus are not limited to the above-described exemplary embodiment, and there are other exemplary embodiments available. The other exemplary embodiments will be described below.

FIG. 11A, FIG. 11B, FIG. 12A, FIG. 12B, FIG. 13A, and FIG. 13B are schematic cross-sectional views each illustrating a transfer device according to a corresponding one of the other exemplary embodiments.

Figure 11A:
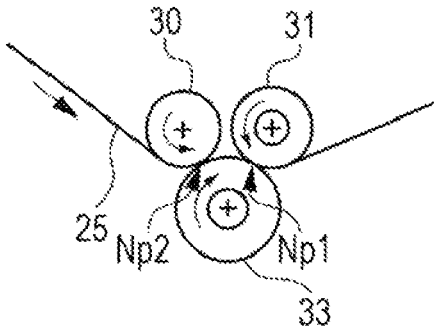
FIGS. 11A and 11B are schematic cross-sectional views each illustrating a transfer device according to a corresponding one of other exemplary embodiments of the invention, FIG. 11A illustrating the configuration illustrated in FIG. 2 with the pre-roller positioned close to the backup roller, and FIG. 11B illustrating the configuration illustrated in FIG. 11A with a pressure pad provided in place of the pre-roller.
Figure 11B:
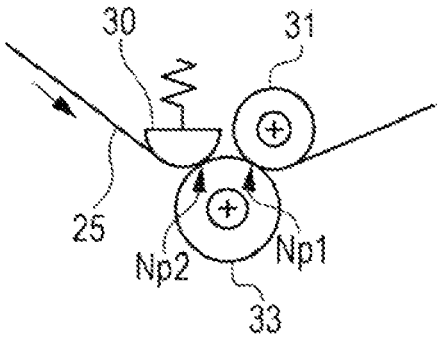

FIGS. 11A and 11B illustrate a configuration in which a pre-roller or a pressure pad that is an alternative to the pre-roller is positioned close to a backup roller.

In the exemplary embodiment illustrated in FIG. 11A, the pre-roller 30 is positioned close to the backup roller 31, and the intermediate transfer belt 25 is pressed against the second transfer roller 33 by the pre-roller 30, so that the second pressing section Np2 is formed. Alternatively, as illustrated in FIG. 11B, the second pressing section Np2 may be formed by pressing the intermediate transfer belt 25 against the second transfer roller 33 using a pressure pad 34 in place of the pre-roller 30 illustrated in FIG. 11A. The pressure pad 34 is disposed on the upstream side of the first pressing section Np1 in the movement direction of the intermediate transfer belt 25 in such a manner as to be pressed into contact with the inner circumferential surface of the intermediate transfer belt 25. A transfer device that suppresses scattering of unfixed toner without increasing the size of the device when a unfixed toner image in the device is transferred onto the recording sheet P is obtained as compared with the case of not having the above-described configuration.

Figure 12A:
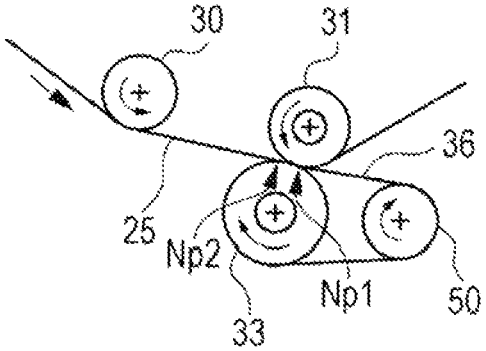
FIGS. 12A and 12B are schematic cross-sectional views each illustrating a transfer device according to a corresponding one of other exemplary embodiments of the invention.
Figure 12B:
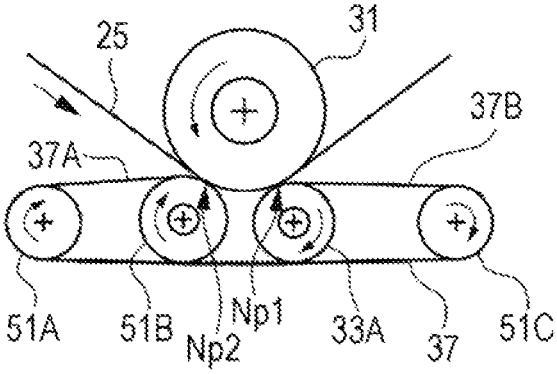

FIGS. 12A and 12B illustrate a configuration in which a second transfer belt is provided in place of a second transfer roller.

FIG. 12A illustrates an exemplary embodiment in which a second transfer belt 36 is used in place of the second transfer roller 33. The second transfer belt 36 is, for example, stretched between the second transfer roller 33 and a roller 50. The intermediate transfer belt 25 is in contact with the second transfer belt 36 due to the first pressure applied from the backup roller 31, so that the first pressing section Np1 is formed. A transfer device that suppresses scattering of unfixed toner without increasing the size of the device when a unfixed toner image in the device is transferred onto the recording sheet P is obtained as compared with the case of not having the above-described configuration.

FIG. 12B illustrates an exemplary embodiment in which a long second transfer belt 37 that includes a section 37A that serves as the pre-roller 30 and a section 37B that serves as the second transfer belt 30 is used. The section 37A of the long second transfer belt 37 is stretched between, for example, a roller 51A and a roller 51B on the upstream side of the backup roller 31, and the section 37B of the long second transfer belt 37 is stretched between, for example, a second transfer roller 33A and a roller 51C on the downstream side of the backup roller 31.

The intermediate transfer belt 25 is in contact with the section 37B of the long second transfer belt 37 due to the first pressure applied from the backup roller 31, so that the first pressing section Np1 is formed. In addition, the intermediate transfer belt 25 is in contact with the section 37A of the long second transfer belt 37 due to the second pressure that is smaller than the first pressure, so that the second pressing section Np2 is formed. A transfer device that suppresses scattering of unfixed toner without increasing the size of the device when a unfixed toner image in the device is transferred onto the recording sheet P is obtained as compared with the case of not having the above-described configuration. The releasing performance is isolated.

Figure 13A:
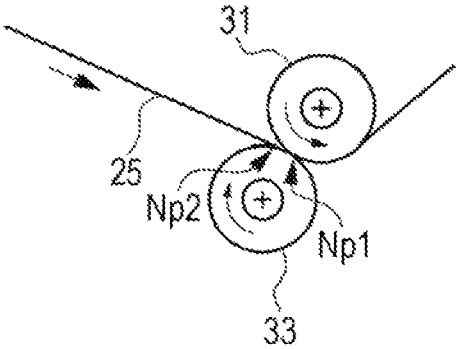
FIGS. 13A and 13B are schematic cross-sectional views each illustrating a transfer device according to a corresponding one of other exemplary embodiments of the invention, FIG. 13A illustrating the configuration illustrated in FIG. 2 without the pre-roller and with the intermediate transfer belt arranged at an angle inclined further toward the horizontal direction, and FIG. 13B illustrating the configuration illustrated in FIG. 2 without the pre-roller and with the backup roller arranged in such a manner that the offset amount of the backup roller is increased in the direction of rotation of the second transfer roller.
Figure 13B:
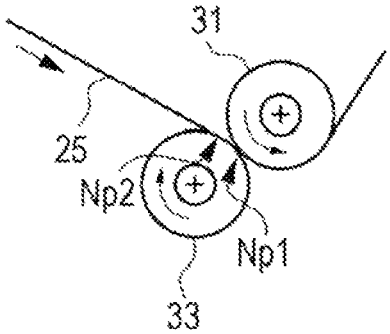

FIGS. 13A and 13B illustrate exemplary embodiments in which the first pressing section Np1 and the second pressing section Np2 are formed using the intermediate transfer belt 25, the backup roller 31, and the second transfer roller 33 without providing the pre-roller 30. More specifically, the backup roller 31 is arranged in such a manner that the offset amount thereof with respect to the second transfer roller 33 is increased when viewed from the intermediate transfer belt 25, so that the second pressing section Np2 is formed.

In FIG. 13A, the intermediate transfer belt 25 is arranged at an angle inclined further toward the horizontal direction and caused to pass between the backup roller 31 and the second transfer roller 33, so that the intermediate transfer belt 25 is in contact with the second transfer roller 33 by the second pressure and is applied with the second pressure in advance on the immediately upstream side of the first pressing section Np1 in the movement direction of the intermediate transfer belt 25.

In FIG. 13B, the backup roller 31 is arranged in such a manner that the offset amount thereof with respect to the second transfer roller 33 is increased when viewed from the intermediate transfer belt 25, so that the second pressing section Np2 is formed. With this configuration, the intermediate transfer belt 25 is in contact with the second transfer roller 33 by the second pressure and is applied with the second pressure in advance on the immediately upstream side of the first pressing section Np1 in the movement direction of the intermediate transfer belt 25. A transfer device that suppresses scattering of unfixed toner with a small number of components when a unfixed toner image in the device is transferred onto the recording sheet P is obtained as compared with the case of not having the above-described configuration.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transfer device comprising:

an endless intermediate transfer belt that moves circularly;

a first rotating body that is disposed in such a manner as to be pressed into contact with an inner circumferential surface of the intermediate transfer belt; and a second rotating body that is disposed at a position facing the first rotating body in such a manner as to be in contact with an outer circumferential surface of the intermediate transfer belt, wherein the intermediate transfer belt includes a first pressing section in which the intermediate transfer belt is in contact with the second rotating body due to a first pressure applied from the first rotating body in such a manner that a toner image that has been first-transferred to the outer circumferential surface of the intermediate transfer belt is second-transferred onto a recording medium that passes between the intermediate transfer belt and the second rotating body and a second pressing section in which the intermediate transfer belt is in contact with the second rotating body due to a second pressure that is smaller than the first pressure on an upstream side of the first pressing section in a movement direction of the intermediate transfer belt.

2. The transfer device according to claim 1, wherein the ratio of a total load of the second pressure in the second pressing section to a total load of the first pressure within the range from a boundary between the second pressing section and the first pressing section to a peak of the first pressure is in the range of about 0.2 to about 0.8.

3. The transfer device according to claim 2, wherein the first pressure continues from a peak of the second pressure while having a nonnegative slope.

4. The transfer device according to claim 3, wherein when a pressure distribution of the second pressure in axial directions of the first rotating body and the second rotating body is approximately expressed by a quadratic function in which a value at substantially the center in the axial directions is minimum, a quadratic coefficient of the quadratic function is a positive number of about 0.001 or smaller.

5. The transfer device according to claim 4, further comprising:

a third rotating body or a pressure pad that is disposed on the upstream side of the first pressing section in the movement direction of the intermediate transfer belt in such a manner as to be pressed into contact with the inner circumferential surface of the intermediate transfer belt, wherein the second pressing section is obtained by generation of the second pressure with the third rotating body or the pressure pad.

6. The transfer device according to claim 3, further comprising:

a third rotating body or a pressure pad that is disposed on the upstream side of the first pressing section in the movement direction of the intermediate transfer belt in such a manner as to be pressed into contact with the inner circumferential surface of the intermediate transfer belt, wherein the second pressing section is obtained by generation of the second pressure with the third rotating body or the pressure pad.

7. The transfer device according to claim 2, wherein when a pressure distribution of the second pressure in axial directions of the first rotating body and the second rotating body is approximately expressed by a quadratic function in which a value at substantially the center in the axial directions is minimum, a quadratic coefficient of the quadratic function is a positive number of about 0.001 or smaller.

8. The transfer device according to claim 7, further comprising:

a third rotating body or a pressure pad that is disposed on the upstream side of the first pressing section in the movement direction of the intermediate transfer belt in such a manner as to be pressed into contact with the inner circumferential surface of the intermediate transfer belt, wherein the second pressing section is obtained by generation of the second pressure with the third rotating body or the pressure pad.

9. The transfer device according to claim 2, further comprising:

a third rotating body or a pressure pad that is disposed on the upstream side of the first pressing section in the movement direction of the intermediate transfer belt in such a manner as to be pressed into contact with the inner circumferential surface of the intermediate transfer belt, wherein the second pressing section is obtained by generation of the second pressure with the third rotating body or the pressure pad.

10. The transfer device according to claim 1, wherein the first pressure continues from a peak of the second pressure while having a nonnegative slope.

11. The transfer device according to claim 10, wherein when a pressure distribution of the second pressure in axial directions of the first rotating body and the second rotating body is approximately expressed by a quadratic function in which a value at substantially the center in the axial directions is minimum, a quadratic coefficient of the quadratic function is a positive number of about 0.001 or smaller.

12. The transfer device according to claim 11, further comprising:

a third rotating body or a pressure pad that is disposed on the upstream side of the first pressing section in the movement direction of the intermediate transfer belt in such a manner as to be pressed into contact with the inner circumferential surface of the intermediate transfer belt, wherein the second pressing section is obtained by generation of the second pressure with the third rotating body or the pressure pad.

13. The transfer device according to claim 10, further comprising:

a third rotating body or a pressure pad that is disposed on the upstream side of the first pressing section in the movement direction of the intermediate transfer belt in such a manner as to be pressed into contact with the inner circumferential surface of the intermediate transfer belt, wherein the second pressing section is obtained by generation of the second pressure with the third rotating body or the pressure pad.

14. The transfer device according to claim 1, wherein when a pressure distribution of the second pressure in axial directions of the first rotating body and the second rotating body is approximately expressed by a quadratic function in which a value at substantially the center in the axial directions is minimum, a quadratic coefficient of the quadratic function is a positive number of about 0.001 or smaller.

15. The transfer device according to claim 14, further comprising:

a third rotating body or a pressure pad that is disposed on the upstream side of the first pressing section in the movement direction of the intermediate transfer belt in such a manner as to foe pressed into contact with the inner circumferential surface of the intermediate transfer belt, wherein the second pressing section is obtained by generation of the second pressure with the third rotating body or the pressure pad.

16. The transfer device according to claim 1, further comprising:

a third rotating body or a pressure pad that is disposed on the upstream side of the first pressing section in the movement direction of the intermediate transfer belt in such a manner as to be pressed into contact with the inner circumferential surface of the intermediate transfer belt, wherein the second pressing section is obtained by generation of the second pressure with the third rotating body or the pressure pad.

17. The transfer device according to claim 1, wherein the second pressing section is obtained by arranging the first rotating body in such a manner that an offset amount of the first rotating body with respect to the second rotating body is increased when viewed from the intermediate transfer belt.

18. The transfer device according to claim 1, wherein the second rotating body is a roller or a belt.

19. An image forming apparatus comprising:

a plurality of image carriers each of which carries a toner image of a different color;

a plurality of first transfer units that transfer the toner images carried by the plurality of image carriers onto an intermediate transfer belt in such a manner that the toner images are superimposed; and a second transfer unit that collectively second-transfers the toner images, which have been first-transferred to the intermediate transfer belt in such a manner that the toner images are superimposed, onto a recording medium, wherein the transfer device according to claim 1 is used as the second transfer unit.

* * * * *